US008109246B2

(12) United States Patent
Gallon et al.

(10) Patent No.: US 8,109,246 B2
(45) Date of Patent: Feb. 7, 2012

(54) CAMSHAFT DAMPING MECHANISM AND METHOD OF ASSEMBLY

(75) Inventors: Robert Jack Gallon, Northville, MI (US); Rodney E. Baker, Fenton, MI (US); Alan W. Hayman, Romeo, MI (US); Robert S McAlpine, Lake Orion, MI (US)

(73) Assignee: GM Global Technology Operations LLC

( * ) Notice: Subject to any disclaimer, the term of this patent is extended or adjusted under 35 U.S.C. 154(b) by 418 days.

(21) Appl. No.: 12/400,331

(22) Filed: Mar. 9, 2009

(65) Prior Publication Data

US 2010/0224155 A1 Sep. 9, 2010

(51) Int. Cl.
*F01L 1/14* (2006.01)

(52) U.S. Cl. ..... 123/90.48; 29/888.03

(58) Field of Classification Search ..... 123/90.48, 123/90.52, 90.55; 29/888.03
See application file for complete search history.

(56) References Cited

U.S. PATENT DOCUMENTS

| | | | | |
|---|---|---|---|---|
| 7,263,956 | B2 * | 9/2007 | Spath et al. | 123/90.16 |
| 2006/0118074 | A1 * | 6/2006 | Haefner | 123/90.48 |
| 2006/0219199 | A1 * | 10/2006 | Geyer et al. | 123/90.48 |

* cited by examiner

*Primary Examiner* — Zelalem Eshete
(74) *Attorney, Agent, or Firm* — Harness, Dickey & Pierce, P.L.C.

(57) ABSTRACT

A camshaft damping mechanism may include first and second housing members and a biasing member. The first housing member may be engaged with a camshaft. The second housing member may be slidably coupled to the first housing member and may abut an engine structure. The biasing member may be retained axially between the first and second housing members and may force the first housing member in an outward axial direction from the second housing member.

20 Claims, 4 Drawing Sheets

FIG 5
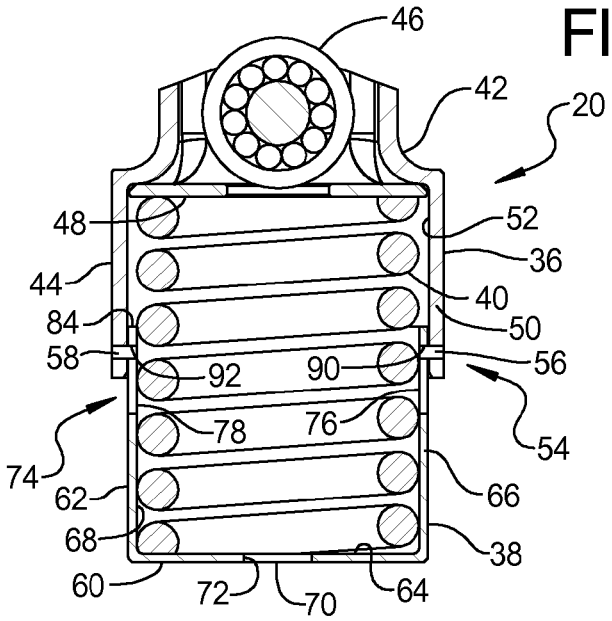
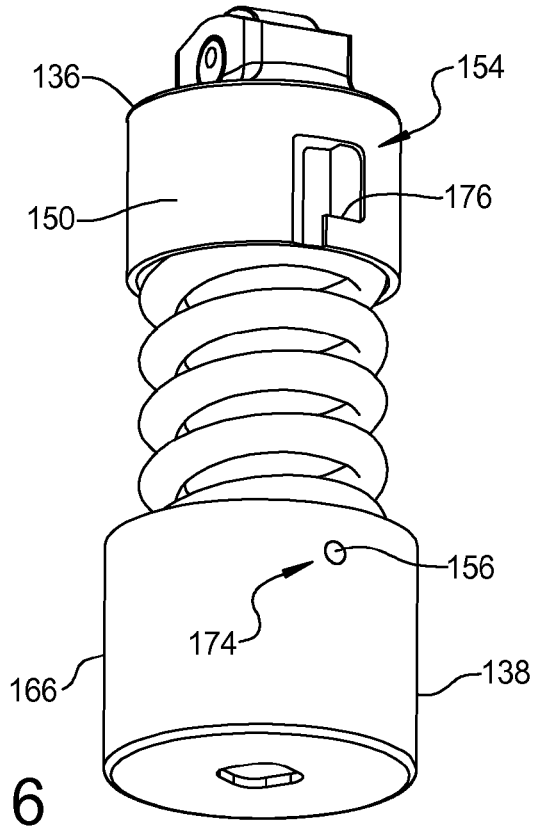
FIG 6

CAMSHAFT DAMPING MECHANISM AND METHOD OF ASSEMBLY

FIELD

The present disclosure relates to mechanisms for damping camshaft vibration.

BACKGROUND

This section provides background information related to the present disclosure which is not necessarily prior art.

Engine assemblies may include a damping mechanism engaged with one or more camshafts to damp a vibrations resulting from a load applied to the camshaft(s) by a drive mechanism, such as a chain drive or a belt drive. These damping mechanisms generally require assembly to the engine block for a cam-in-block engine or to the cylinder head for an overhead cam engine configuration. The additional assembly typically required may result in greater assembly time and expense in assembling an engine.

SUMMARY

This section provides a general summary of the disclosure, and is not comprehensive of its full scope or all of its features.

A camshaft damping mechanism may include first and second housing members and a biasing member. The first housing member may be engaged with a camshaft. The second housing member may be slidably coupled to the first housing member and may abut an engine structure. The biasing member may be retained axially between the first and second housing members and may force the first housing member in an outward axial direction from the second housing member.

A method of assembling an engine may include assembling a camshaft damping mechanism including a first housing member, a second housing member slidably coupled to the first housing member, and a biasing member retained axially between the first and second housing members and forcing the first housing member in an outward axial direction from the second housing member. The method may further include locating the camshaft damping mechanism on an engine structure. The second housing member may abut the engine structure after the locating. The camshaft may be secured to the engine structure and may overly and abut the first housing member of the camshaft damping mechanism to secure the camshaft damping mechanism between the camshaft and the engine structure.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only and are not intended to limit the scope of the present disclosure in any way.

FIG. 5 is a section view of the camshaft damping mechanism of FIG. 2; and FIG. 6 is a perspective exploded view of an alternate camshaft damping mechanism according to the present disclosure.

Corresponding reference numerals indicate corresponding parts throughout the several views of the drawings.

DETAILED DESCRIPTION

Examples of the present disclosure will now be described more fully with reference to the accompanying drawings. The following description is merely exemplary in nature and is not intended to limit the present disclosure, application, or uses.

Figure 1:
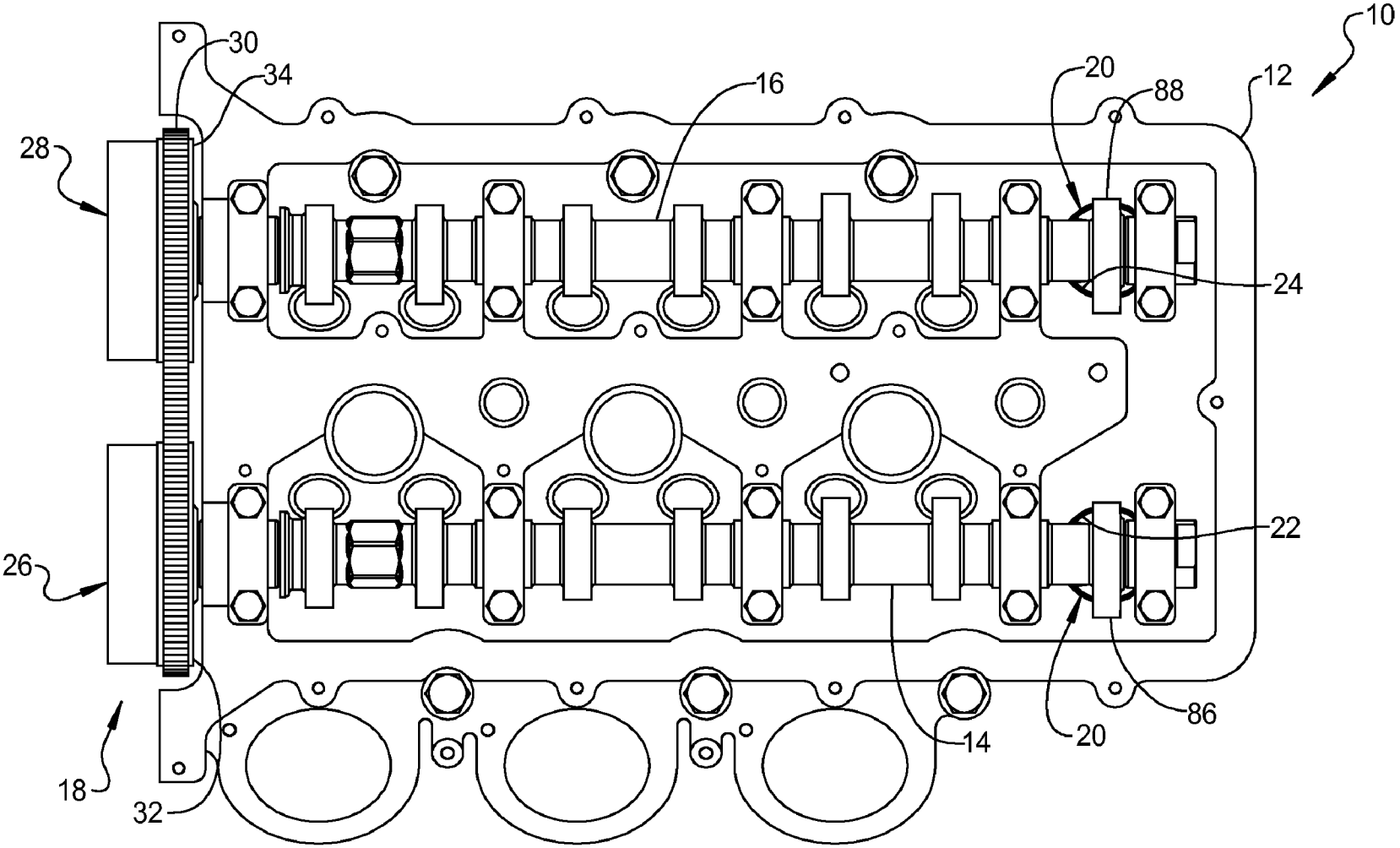
FIG. 1 is plan view of a portion of an engine assembly according to the present disclosure.
Figure 2:
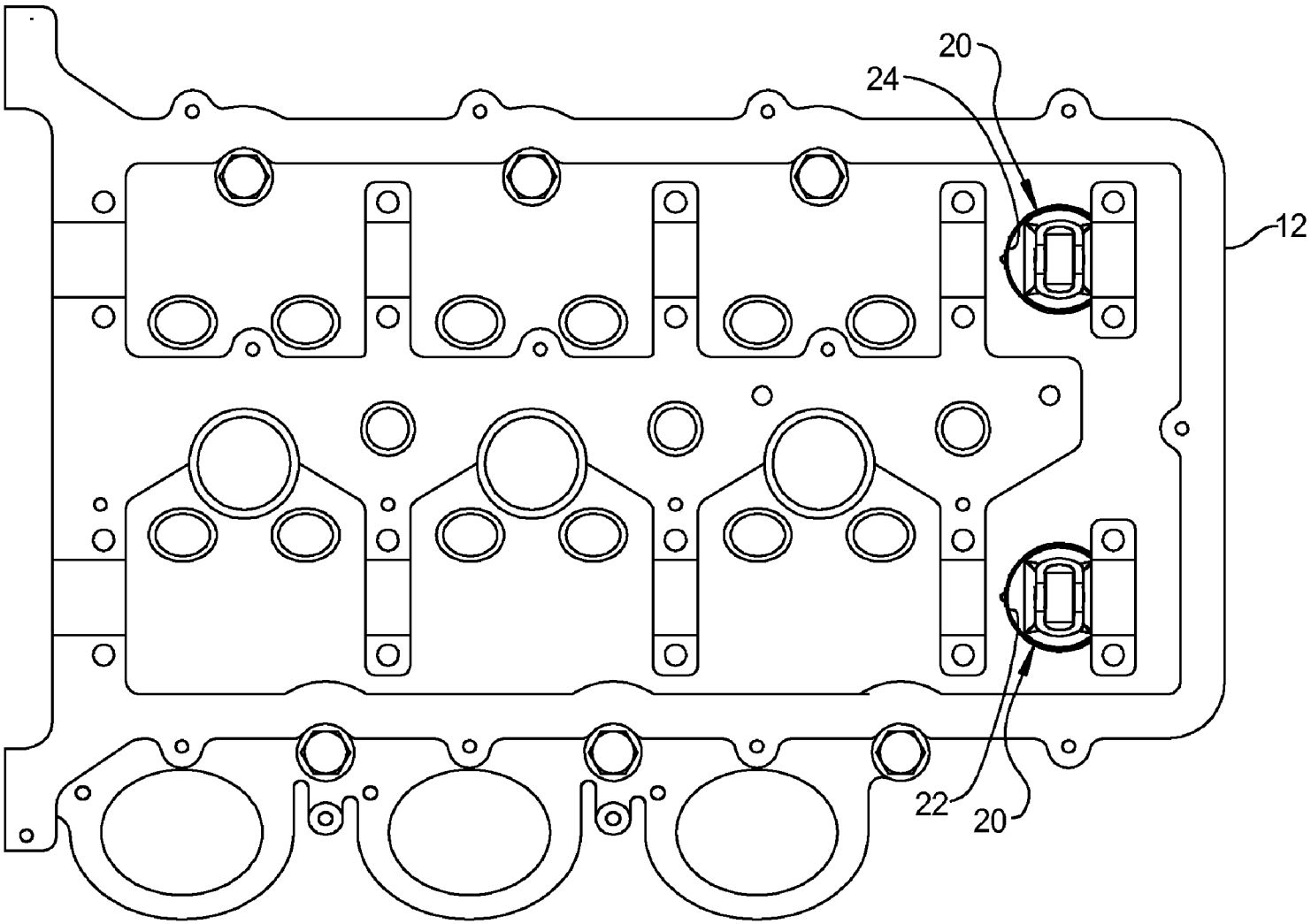
FIG. 2 is a plan view of a cylinder head and camshaft damping mechanisms of the engine assembly of FIG. 1.

Referring now to FIGS. 1 and 2, a portion of an engine assembly 10 is illustrated. The engine assembly 10 may include a cylinder head 12, intake and exhaust camshafts 14, 16, a camshaft drive assembly 18, and camshaft damping mechanisms 20. The cylinder head 12 may generally define an engine structure supporting the intake and exhaust camshafts 14, 16 and the camshaft damping mechanisms 20. The cylinder head 12 may define first and second recesses 22, 24 housing the camshaft damping mechanisms 20 therein.

While the camshaft damping mechanisms 20 are illustrated in combination with a cylinder head of a dual overhead camshaft engine, it is understood that the present teachings are not limited to such a configuration. By way of non-limiting example, the camshaft damping mechanisms 20 may be incorporated into single overhead camshaft engine configurations, as well as cam-in-block engine configurations. In a cam-in-block configuration, the first and second recesses 22, 24 defined in the cylinder head 12 of the present disclosure may be located within an engine block (not shown). Further, it is understood that the present teachings may be incorporated into engine configurations including, but not limited to, in-line engines and V-engines.

The camshaft drive assembly 18 may include intake and exhaust cam phasers 26, 28 and a drive member 30. The drive member 30 may be in a variety of forms including, but not limited to, a drive chain or a drive belt. The intake cam phaser 26 may be coupled to the intake camshaft 14 and the exhaust cam phaser 28 may be coupled to the exhaust camshaft 16. The intake cam phaser 26 may include a first drive sprocket 32 and the exhaust cam phaser 28 may include a second drive sprocket 34. The first and second drive sprockets 32, 34 may each be engaged with and rotatably driven by the drive member 30. The drive member 30 may be driven by a rotating member such as a crankshaft (not shown). The camshaft damping mechanisms 20 may reduce vibration of the intake and exhaust camshafts 14, 16 resulting from loads imparted on the intake and exhaust camshafts 14,16 from the camshaft drive assembly 18.

Figure 3:
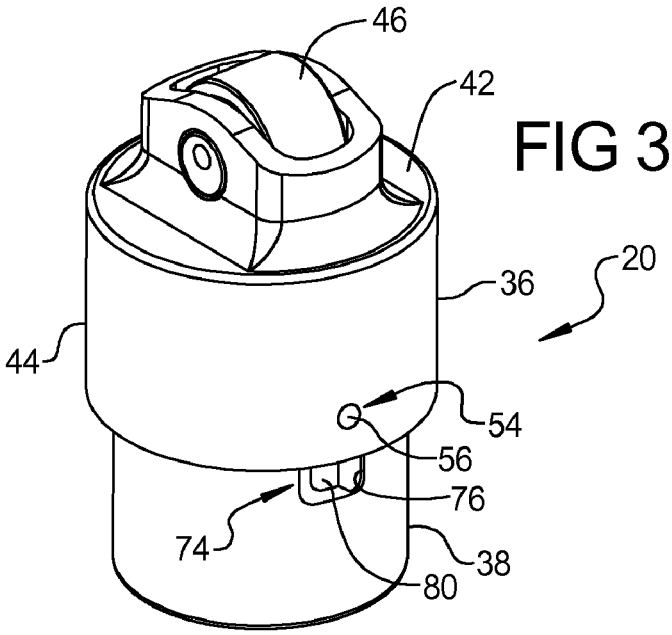
FIG. 3 is a perspective view of the camshaft damping mechanism of FIG. 2.
Figure 4:
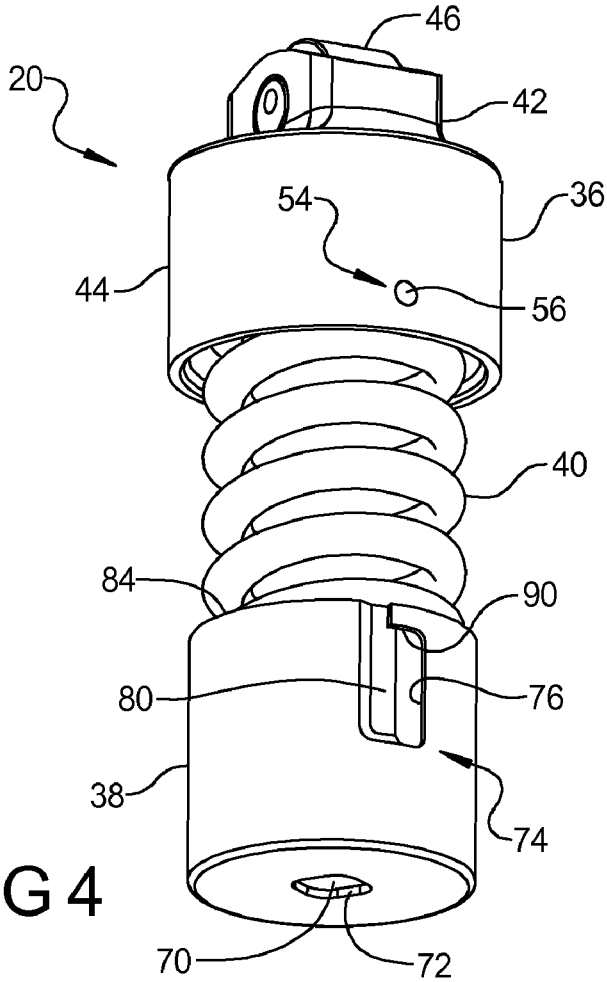
FIG. 4 is a perspective exploded view of the camshaft damping mechanism of FIG. 2.

Referring now to FIGS. 3-5, the camshaft damping mechanism 20 may include a first housing member 36, a second housing member 38, and a biasing member 40. The first housing member 36 may include an axially extending body having first and second portions 42, 44. The first portion 42 may include a roller member 46 on a first side thereof and may define a first seating surface 48 on a second side thereof generally opposite the first side. The roller member 46 on one of the camshaft damping mechanisms 20 may engage the intake camshaft 14 and the roller member 46 on the other camshaft damping mechanism 20 may engage the exhaust camshaft 16. The second portion 44 may include a first annular wall 50 extending axially from the first seating surface 48 and defining a first cavity 52. The second portion 44 may additionally include a first retention mechanism 54. The first retention mechanism 54 may include first and second pins 56, 58 extending radially inward from and axially fixed to the first annular wall 50. The first and second pins 56, 58 may be spaced approximately one hundred and eighty degrees from one another.

The second housing member 38 may include an axially extending body having first and second portions 60, 62. The first portion 60 may define a second seating surface 64 and the second portion 62 may include a second annular wall 66 extending axially from the second seating surface 64 and defining a second cavity 68. The second seating surface 64 may include an aperture 70 defining an oil drain hole. The aperture 70 may define a series of flats 72 for engagement with a tool (not shown) to rotationally fix the second housing member 38 during assembly of the camshaft damping mechanism 20. The second portion 62 may additionally include a second retention mechanism 74.

The second retention mechanism 74 may include first and second axial slots 76, 78 extending along the second annular wall 66 and first and second axial recesses 80 (one of which is shown) extending along the second annular wall 66 directly adjacent the first and second axial slots 76, 78. The first and second axial slots 76, 78 may extend radially through the second annular wall 66 and may each be located axially inward from an end of the second annular wall 66 adjacent the first housing member 36. The first and second axial recesses 80 may extend radially into the second annular wall 66 a distance less than the thickness of the second annular wall 66 and may extend axially through the end 84 of the second annular wall 66.

The first annular wall 50 may be slidably disposed within the second annular wall 66 and axially secured thereto through an engagement between the first and second retention mechanisms 54, 74. More specifically, the first and second pins 56, 58 may be located within the first and second axial slots 76, 78. The biasing member 40 may be retained axially between the first and second housing members 36, 38 between the first and second seating surfaces 48, 64. The biasing member 40 may be housed within the first and second cavities 52, 68 and may generally urge the first and second housing members 36, 38 axially outward relative to one another. By way of non-limiting example, the biasing member 40 may include a compression spring.

The engagement between the first and second pins 56, 58 and the first and second axial slots 76, 78 may provide guided axial displacement between the first and second housing members 36, 38 while axially securing the first and second housing members 36, 38 to one another. During engine operation, and by way of non-limiting example, the second housing member 38 may be axially fixed relative to the cylinder head 12 and the first housing member 36 may be axially displaceable relative to the second housing member 38 and the cylinder head 12. The first housing member 36 of a first camshaft damping mechanism 20 may be displaced between first and second axial positions based on engagement with a lobe member 86 (seen in FIG. 1) of the intake camshaft 14 and a second camshaft damping mechanism 20 may be displaced between first and second axial positions based on engagement with a lobe member 88 (seen in FIG. 1) of the exhaust camshaft 16.

The camshaft damping mechanisms 20 may be assembled before being located in the cylinder head 12. During assembly, the biasing member 40 may be located within the second cavity 68 of the second housing member 38. The first and second pins 56, 58 on the first housing member 36 may then be rotationally aligned with the first and second axial recesses 80. Next, the first housing member 36 may be advanced axially relative to the second housing member 38. As the first housing member 36 is advanced axially toward the second housing member 38, the first and second pins 56, 58 advance axially along the first and second axial recesses 80 and the biasing member 40 is compressed.

Once the first and second pins 56, 58 are axially aligned with the first and second axial slots 76, 78, the first housing member 36 may be rotated relative to the second housing member 38 in a rotational direction from the first and second axial recesses 80 toward the first and second axial slots 76, 78. After the first and second pins 56, 58 are located within the first and second axial slots 76, 78, the axial force applied to the first housing member 36 to axially advance the first housing member 36 may be removed and the biasing member 40 may urge the first housing member 36 axially outward from the second housing member 38 and may bias the first and second pins 56, 58 against ends 90, 92 of the first and second axial slots 74, 76, securing the first housing member 36, the second housing member 38, and the biasing member 40 to one another as an unitary member.

Once assembled, the camshaft damping mechanisms 20 may be located in the recesses 22, 24 in the cylinder head 12. After the camshaft damping mechanisms 20 have been located in the recesses 22, 24, the intake and exhaust camshafts 14, 16 may be secured to the cylinder head 12. The first camshaft damping mechanism 20 may be secured between the intake camshaft 14 and the cylinder head 12 and the second camshaft damping mechanism 20 may be secured between the exhaust camshaft 16 and the cylinder head 12, eliminating the need for additional fasteners and assembly processes to secure the camshaft damping mechanisms 20 to the cylinder head 12.

An alternate camshaft damping mechanism 120 is illustrated in FIG. 6. The camshaft damping mechanism 120 may be generally similar to the camshaft damping mechanism 20. Therefore, it is understood that the description of the camshaft damping mechanism 20 applies equally to the camshaft damping mechanism 120 with the exceptions indicated below. The first retention mechanism 154 of the first housing member 136 may include first and second axial slots 176 (one of which is shown) located in the first annular wall 150. The second retention mechanism 174 of the second housing member 138 may include first and second pins 156 (one of which is shown) extending radially inward from the second annular wall 166. The second annular wall 166 may be slidably disposed within the first annular wall 150 and the first and second pins 156 may be slidably disposed within the first and second axial slots 176 to guide axial displacement between the first and second housing members 136, 138 and axially secure the first and second housing members 136, 138 to one another.

It is understood that the description of the engagement between the first and second housing members 36, 38 and the first and second housing members 136, 138 is merely exemplary in nature and that the present teachings are in no way limited to the configurations described above.

What is claimed is:

1. A camshaft damping mechanism comprising:

a first housing member engaged with a camshaft;

a second housing member slidably coupled to the first housing member and abutting an engine structure defined by one of a cylinder head and an engine block; and a biasing member retained axially between the first and second housing members and forcing the first housing member in an outward axial direction from the second housing member and forcing the second housing member against the engine structure to fix the second housing member axially relative to the engine structure and secure the camshaft damping mechanism between the camshaft and the engine structure.

2. The camshaft damping mechanism of claim 1, wherein the first housing member is axially displaceable between first and second positions relative to the second housing member and the first and second housing members are axially secured to one another when the first housing member is in the first and second positions, the first housing member being displaced a maximum axial distance from the second housing member when in the first position and being displaced a maximum axial distance toward the second housing member when in the second position.

3. The camshaft damping mechanism of claim 1, wherein the first housing member includes a first retention mechanism and the second housing member includes a second retention mechanism slidably engaged with the first retention mechanism and guiding axial displacement of the first housing member relative to the second housing member with the engagement between the first and second retention mechanisms axially securing the first housing member to the second housing member.

4. The camshaft damping mechanism of claim 3, wherein the first housing member defines a first axially extending body including a pin member extending radially therefrom and the second housing member defines a second axially extending body including an axially extending slot having the pin member slidably disposed therein, the engagement between the pin member and the slot axially securing the first housing member to the second housing member.

5. The camshaft damping mechanism of claim 4, wherein the second axially extending body is slidably disposed within the first axially extending body.

6. The camshaft damping mechanism of claim 4, wherein the second axially extending body includes an axially extending recess extending radially into the second axially extending wall directly adjacent the slot, the recess extending to an axial end of the second housing member adjacent the first housing member and providing a path for the pin member to be located within the slot during assembly.

7. The camshaft damping mechanism of claim 3, wherein the first housing member defines a first axially extending body including an axially extending slot and the second housing member defines a second axially extending body including a pin member extending radially therefrom and slidably disposed within the slot, the engagement between the pin member and the slot axially securing the first housing member to the second housing member.

8. The camshaft damping mechanism of claim 1, wherein the first housing member includes a roller member engaged with the camshaft.

9. A method comprising:

assembling a camshaft damping mechanism including a first housing member, a second housing member slidably coupled to the first housing member, and a biasing member retained axially between the first and second housing members and forcing the first housing member in an outward axial direction from the second housing member;

locating the camshaft damping mechanism on an engine structure, the second housing member abutting one of a cylinder head and an engine block defining the engine structure after the locating; and securing a camshaft to the engine structure, the camshaft overlying and abutting the first housing member of the camshaft damping mechanism to secure the camshaft damping mechanism between the camshaft and the engine structure and fix the second housing member axially relative to the engine structure.

10. The method of claim 9, wherein the first housing member includes a first retention mechanism and the second housing member includes a second retention mechanism, the assembling including providing engagement between the first and second retention mechanisms to axially secure the first housing member to the second housing member.

11. The method of claim 10, wherein the first housing member defines a first axially extending body including a pin member extending radially therefrom and the second housing member defines a second axially extending body including an axially extending slot, the assembling including locating the pin member within the slot, the engagement between the pin member and the slot axially securing the first housing member to the second housing member.

12. The method of claim 11, wherein the second axially extending body includes an axially extending recess extending radially into the second axially extending wall directly adjacent the slot, the recess extending to an axial end of the second housing member adjacent the first housing member, the assembling including advancing the pin member axially along the recess until the pin member is axially aligned with a portion of the slot and rotating the first housing member relative to the second housing member in a rotational direction from the recess to the slot after the advancing to locate the pin member within the slot.

13. The method of claim 10, wherein the first housing member defines a first axially extending body including an axially extending slot and the second housing member defines a second axially extending body including a pin member extending radially therefrom, the assembling including locating the pin member within the slot, the engagement between the pin member and the slot axially securing the first housing member to the second housing member.

14. The method of claim 13, wherein the first axially extending body includes an axially extending recess extending radially into the first axially extending wall directly adjacent the slot, the recess extending to an axial end of the first housing member adjacent the second housing member, the assembling including advancing the pin member axially along the recess until the pin member is axially aligned with a portion of the slot and rotating the first housing member relative to the second housing member in a rotational direction from the recess to the slot after the advancing to locate the pin member within the slot.

15. The method of claim 9, wherein the camshaft damping mechanism is secured to the engine structure solely by the abutment between the camshaft damping mechanism and the engine structure and the abutment between the camshaft damping mechanism and the camshaft.

16. The method of claim 15, wherein the locating the camshaft damping mechanism on the engine structure includes locating the camshaft damping mechanism in a recess formed in the engine structure.

17. The method of claim 9, wherein the camshaft damping mechanism is fully assembled before the locating.

18. An engine assembly comprising:

an engine structure;

a camshaft supported on the engine structure; and a camshaft damping mechanism located between the engine structure and the camshaft and including:

a first housing member engaged with the camshaft;

a second housing member slidably coupled to the first housing member and abutting one of a cylinder head and an engine block defining the engine structure; and a biasing member retained axially between the first and second housing members and forcing the first housing member in an outward axial direction from the second housing member into engagement with the camshaft and forcing the second housing member against the engine structure and fixing the second housing member axially relative to the engine structure.

19. The engine assembly of claim 18, wherein the second housing member abuts and is axially fixed relative to the cylinder head.

20. The engine assembly of claim 18, wherein the first housing member defines a first axially extending body and the second housing member defines a second axially extending body, one of the first and second axially extending bodies including a pin member extending radially therefrom and the other of the first and second axially extending bodies including an axially extending slot having the pin member slidably disposed therein, the engagement between the pin member and the slot axially securing the first housing member to the second housing member.

* * * * *